US007633457B2

(12) United States Patent
Christ

(10) Patent No.: US 7,633,457 B2
(45) Date of Patent: Dec. 15, 2009

(54) CLADDING FOR A MICROWAVE ANTENNA

(75) Inventor: Jochen Christ, Besigheim (DE)

(73) Assignee: Ericsson AB, Stockholm (SE)

( * ) Notice: Subject to any disclaimer, the term of this patent is extended or adjusted under 35 U.S.C. 154(b) by 143 days.

(21) Appl. No.: 10/597,212

(22) PCT Filed: Jan. 7, 2005

(86) PCT No.: PCT/EP2005/050068

§ 371 (c)(1),
(2), (4) Date: Nov. 28, 2007

(87) PCT Pub. No.: WO2005/069435

PCT Pub. Date: Jul. 28, 2005

(65) Prior Publication Data

US 2008/0224939 A1 Sep. 18, 2008

(30) Foreign Application Priority Data

Jan. 15, 2004 (DE) ..... 10 2004 002 374

(51) Int. Cl.
*H01Q 1/42* (2006.01)

(52) U.S. Cl. ..... 343/872

(58) Field of Classification Search ..... 343/872, 343/873

See application file for complete search history.

(56) References Cited

U.S. PATENT DOCUMENTS

| | | | | |
|---|---|---|---|---|
| 6,452,560 | B2 * | 9/2002 | Kunysz | 343/770 |
| 6,466,177 | B1 * | 10/2002 | Kunysz | 343/769 |
| 6,674,412 | B1 | 1/2004 | Schmidt et al. | |
| 2002/0067305 | A1 | 6/2002 | LeBlanc et al. | |

FOREIGN PATENT DOCUMENTS

| | | |
|---|---|---|
| DE | 4412770 | 10/1995 |
| DE | 197 24 320 A1 * | 6/1997 |
| DE | 19902511 | 8/2000 |
| EP | 789421 | 12/2002 |

OTHER PUBLICATIONS

Tai, C. T. ed. "Radoms and Absorbers." Antenna Engineering Handbook. New York: McGraw-Hill, US, 1961, pp. 3202-3212, XP002324724.

* cited by examiner

*Primary Examiner*—Shih-Chao Chen
(74) *Attorney, Agent, or Firm*—Coats & Bennett, P.L.L.C.

(57) ABSTRACT

A cladding plate (2) for a microwave antenna has a thickness which increases with the distance r from a point of minimum thickness (11) proportional to Formula (I) wherein $\in_R$ is the dielectric constant of the material of the cladding plate and a is a positive constant.

12 Claims, 5 Drawing Sheets

CLADDING FOR A MICROWAVE ANTENNA

DESCRIPTION

The present invention relates to a cladding plate for cladding a microwave antenna, and an assembly comprising such a cladding plate and a microwave antenna.

BACKGROUND OF THE INVENTION

Such antennas, which may be highly directional antennas for point-to-point transmission or sector antennas for point-to-multipoint transmission must often be covered by cladding plates on buildings in order to avoid a deterioration of the aspect of the building. Such cladding plates inevitably have an influence on the radiation pattern of the antenna. In order to keep this influence small, it is known e.g. from DE 199 02 511 A1 to adapt the thickness d of such a cladding plate to the vacuum wavelength $\lambda_0$ of the radiation emitted by the antenna and to the dielectric constant $\in_R$ of the plate material according to the formula $$d = \frac{m}{2}\frac{\lambda_0}{\sqrt{\varepsilon_R}}.$$

A beam which is oriented perpendicular to the plate surface and is reflected at the exit side of the plate reaches the incidence side delayed by m wavelengths, so that it interferes, due to a phase shift $\pi$ at the boundary, in phase opposition with the incident beam and thus suppresses reflection at the cladding plate.

A wave which is not incident perpendicularly on the cladding plate has to propagate in it on a longer path, so that the condition for absence of reflection is no longer fulfilled, and the transmission through the cladding plate may be attenuated considerably.

FIG. 1 illustrates this problem by means of azimuth cuts of the directivity pattern of an assembly formed of a 90° sector antenna and a cladding plate made of glass fibre-reinforced plastic which is perpendicular to a main beam direction of the sector antenna. The cut shown as a solid line exhibits a slight, tolerable angular dependency of the amplitude inside the sector and a strongly varying amplitude at low levels outside the sector. In practice, perpendicular incidence can often not be realized because the orientation of the cladding plate is in most cases predetermined by the outline of a building facade behind which the antenna is mounted, whereas the orientation of the antenna is defined by constraints such as the position of a cell to be covered by the antenna or, in case of a point-to-point connection, the position of a partner antenna, which constraints have no relation to the building. Considering the case of the main beam direction of the antenna and the surface normal of the cladding plate forming an angle of 20° with respect to each other in the horizontal plane, as represented in FIG. 1 as a dashed line, it is found that the reflection, which is now no longer suppressed completely at the cladding plate, causes a specular image of the antenna beam to appear at angles above 100°. In a practically relevant assembly in which four 90°-sector antennas located at a same place cover four radio cells which meet at the place of the antenna, this means that the radio signal of the considered antenna is radiated with a non-negligible intensity into one of the other cells and affects reception there.

FIG. 2 illustrates the problem in the elevation direction. As shown in curve E of the elevation cut, the beam is strongly directed in the horizontal direction, in order to achieve a wide range at a low transmission power. Off the horizontal plane the radiated intensity is much lower, but it must not vanish because otherwise reception would not be possible in a close range around an antenna mounted in an elevated position. The curve E of the elevation cut should therefore extend between two constraint curves R+, R−. This may be achieved with an uncladded antenna, but with a cladded antenna, the problem arises that the intensity radiated at a non-vanishing angle with respect to the horizontal plane cannot fulfil the condition for absence of reflection at the same time as the intensity radiated in the horizontal direction. Due to reflection losses, the elevation cut E of the cladded antenna drops below the constraint curve R− in some places.

SUMMARY

The object of the present invention is to provide a cladding plate for a microwave antenna and an antenna assembly comprising a microwave antenna and a cladding plate extending through the beam of the microwave antenna, which allow suppression of unwanted reflections of the beam of the antenna at the cladding plate even if the cladding plate and the main beam direction of the antenna are not exactly perpendicular to each other.

The object is achieved by a cladding plate having the features of claim 1 and an antenna assembly having the features of claim 8.

The invention is based on the use of a cladding plate, the thickness of which increases from a central point of minimum thickness with increasing distance r from this point. While the minimum thickness for a given wavelength of the antenna fulfils the condition indicated above for vanishing reflection at perpendicular incidence, at the other points the thickness is increased so that a beam which enters into the cladding plate at such a point from the inner side thereof is reflected at its outer side and reaches the inner side again at another point, where it interferes in phase opposition with a beam arriving there from the antenna. This requirement can be fulfilled exactly if the thickness of the cladding plate varies with the distance r in proportion to $$1/\sqrt{1-(\in_R+a/r^2)^{-1}},$$

wherein $\in_R$ is the dielectric constant of the material of the cladding plate, and a is a positive constant.

If the cladding plate is employed in a specific antenna assembly, $a=\in_R\times D^2$ should be fulfilled, wherein D is the distance of the microwave antenna from the cladding plate.

In order to ensure a high optical quality of the cladding plate, its thickness profile is preferably obtained by milling from bulk material. Preferably, material is removed by layers, so that a thickness profile results in which the thickness of the cladding plate increases stepwise from the point of minimum thickness.

The height of the steps should not be more than 100 μm, preferably several 10 μm or less.

Preferably the cladding plate is manufactured from a homogeneous material, in particular a plastic such as polymethylmethacrylate, polycarbonate, or the like.

The required dimensions of such a cladding plate may make it appropriate to assemble it from several pieces. In such a case, it is practical that the pieces meet at the point of minimum thickness, so that for a given cladding plate, several pieces having an identical thickness profile may be economically manufactured in series.

Further features and advantages of the invention become apparent from the subsequent description of embodiments referring to the appended drawings.

DETAILED DESCRIPTION OF THE INVENTION

Figure 3:
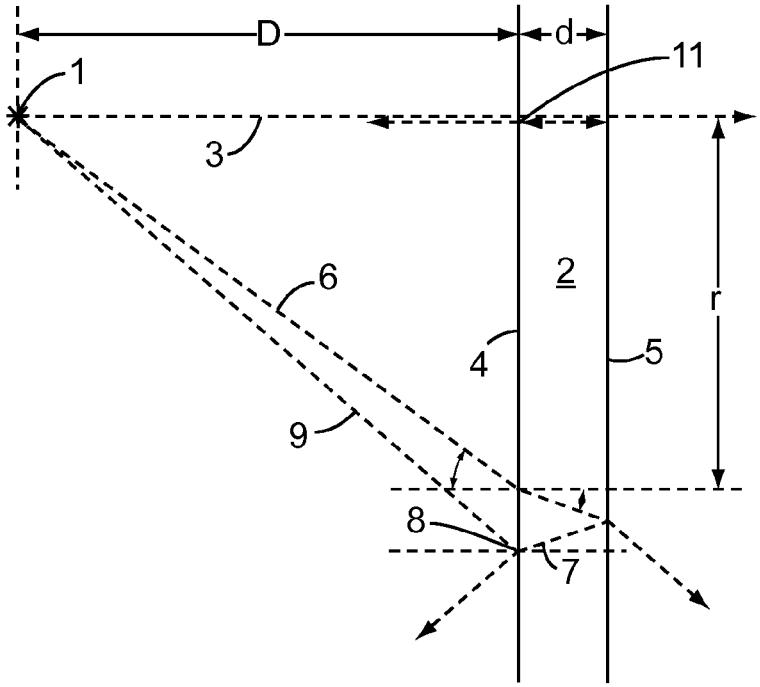
FIG. 3 shows a schematic cut through an antenna assembly according to the invention.

FIG. 3 illustrates the geometry on which the invention is based. The radio transmitter is assumed to be a point source, represented in the figure as an asterisk 1. The radio transmitter 1 is located at a distance D from a cladding plate 2, measured along a surface normal of the cladding plate. In order for the approximation of the radio transmitter 1 as a point source to make sense, the distance between the radio transmitter 1 and the cladding plate should in practice amount to several wavelengths, typically 10 to 20. The thickness d of the cladding plate is assumed to be much less than D.

A beam 3 of a radio signal which impinges on the point of minimum thickness 11 of the cladding plate 2 along a surface normal thereof is partially reflected at the input side 4 of plate 2 and is partially transmitted into the cladding plate 2. The transmitted part is again partially reflected at its output side 5 and the parts reflected at sides 4, 5 interfere at input side 4. The part reflected at the output side experiences a phase shift 7*c* when passing from the cladding plate 2 into air, which is optically thinner. In order to achieve minimum reflection, the part reflected immediately at the input side 4 and the part reflected at the output side 5 must have a phase difference of π. If $\in_R$ is the dielectric constant of the material of the cladding plate 2, and $\lambda_0$ is the vacuum wavelength of the radio beam, $$m\lambda_0=2\sqrt{\in_R}d$$

holds, m being an integer.

A radio beam 6 which is incident on the input side 4 at an angle α different from 0° propagates obliquely through the cladding plate 2, and its reflected part 7 reaches the input side 4 at a point 8, where a beam 9 impinges, which has propagated from radio transmitter 1 along a path which is longer than that of beam 6 to its point of incidence. In order to have the part 7 of beam 6 reflected at output side 5 and the part of beam 9 reflected at point 8 cancel each other, the thickness d of the cladding plate 2 must fulfil the condition $$d = m\frac{\lambda}{\sqrt{\varepsilon_R - \sin^2\alpha}}, \tag{1}$$

α being the angle of incidence of the beam 6 at the input side 4. In other words, in order to be free of reflection, a cladding plate must have a thickness which increases all around a point of minimum thickness in proportion to $$1/\sqrt{1-(\in_R+a/r^2)^{-1}},$$

r being the distance from said point, and the distance D between antenna and cladding plate which ensures optimal freedom from reflection is defined by $$D=\sqrt{a/\in_R}.$$

Figure 4:
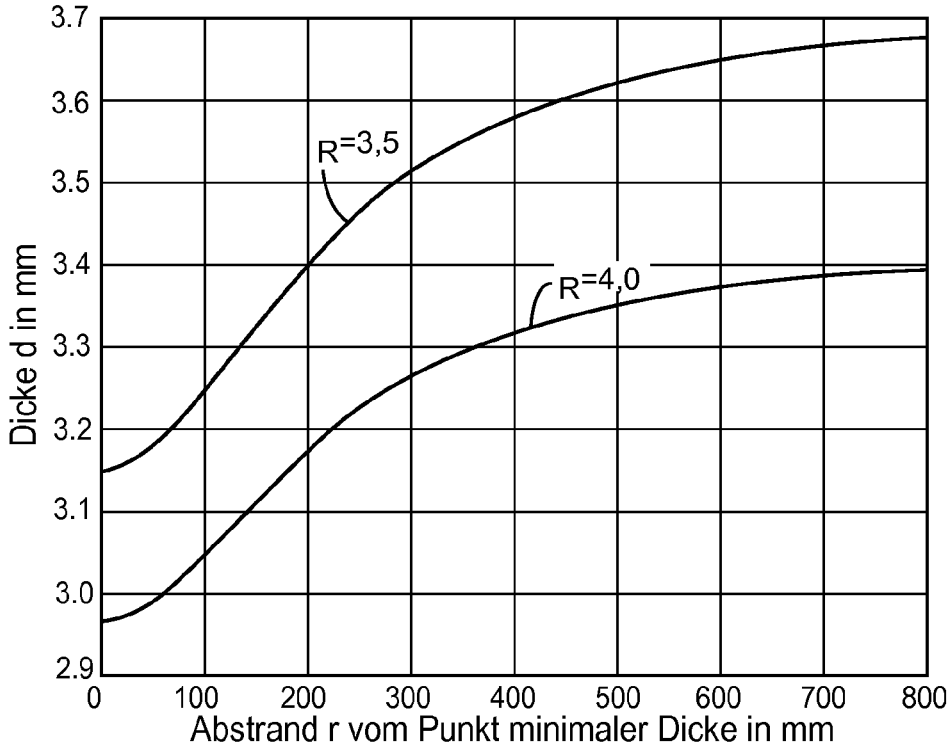
FIG. 4 shows a specific example of a thickness profile of a cladding plate according to the invention.

FIG. 4 gives a numerical example for the dependence of the plate thickness d, given in millimeters, on the distance r from the point of minimum thickness for dielectric figures $\in_R$=3.5 and $\in_R$=4.0, respectively. The thickness difference between a central thinnest point of the plate and its thick outer regions amounts to fractions of a wavelength and is hardly perceptible in a plate. For mounting the radio transmitter 1 and the cladding plate 2 with respect to each other, it may be helpful if signs are printed or engraved on the cladding plate 2 which indicate the position of the thinnest point 11.

According to a preferred embodiment, the cladding plate 2 is manufactured by milling a recess in a plate made of homogeneous plastic material such as polycarbonate or polymethylmethacrylate. If the plate is machined in successive layers, as shown in the perspective view of an embodiment of the cladding plate in FIG. 5, a step thickness profile results, the edges 10 of which remain visible at the surface of the cladding plate, thus indicating the position of the thinnest point 11, so that when the radio transmitter and the cladding plate are assembled, it is easy to ensure that the radio transmitter 1 is located at the surface normal of the plate at its thinnest point.

In order to ensure a good optical quality of the cladding plate, the steps should be as narrow and as shallow as possible. In the case shown in FIG. 5, the thickness difference of typically 0.5 to 0.6 mm between the thinnest and the thickest place of plate 2 is distributed to 17 steps, corresponding to a mean step height of about 35 μm. A step height of approximately 100 μm should not be exceeded. Of course, it is also conceivable to mill the thickness profile of cladding plate 2 with a smaller number of steps and to flatten the resulting edges 10 afterwards by polishing.

Figure 5:
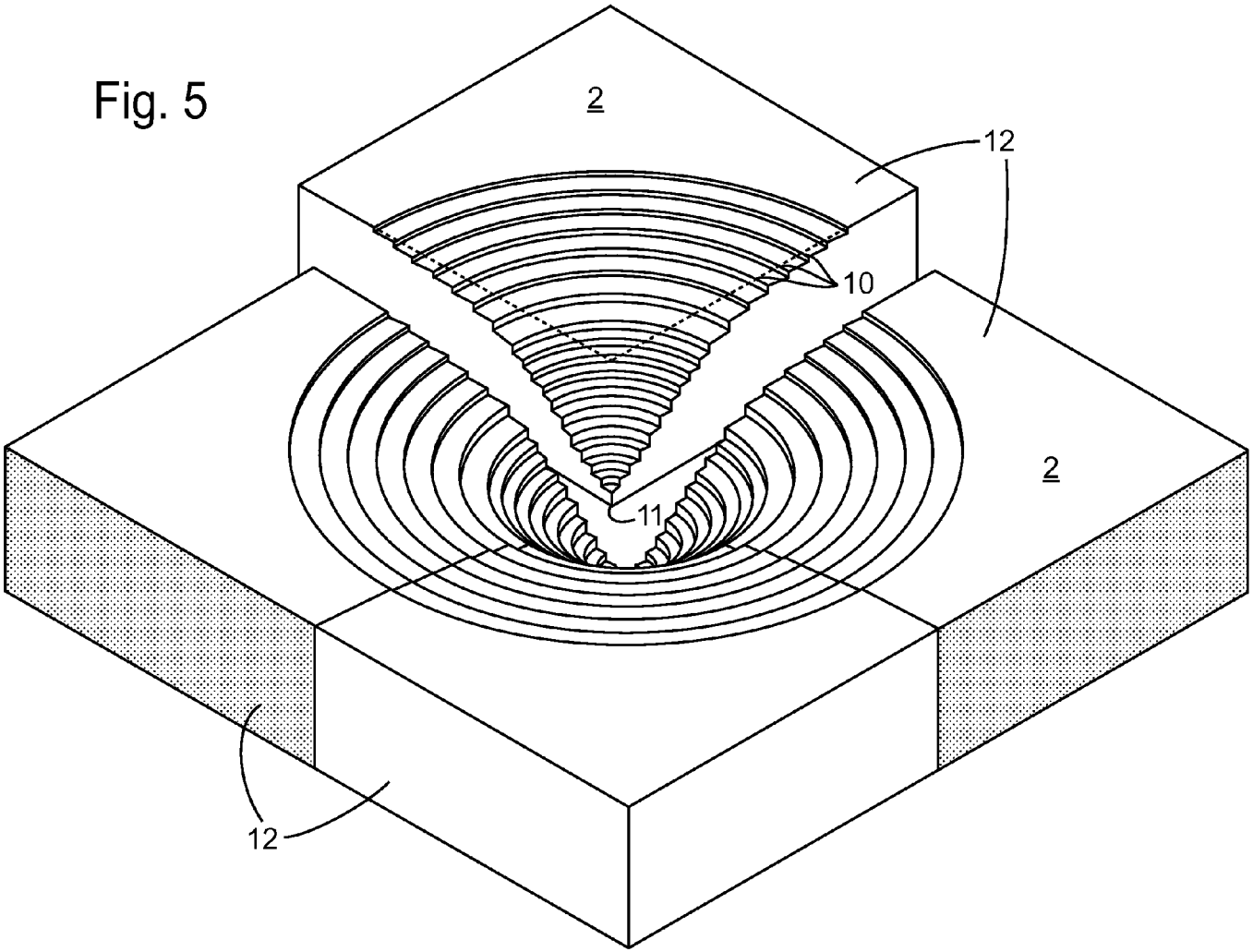
FIG. 5 shows a cladding plate assembled from several pieces.

The cladding plate 2 of FIG. 5 is composed of four segments 12, all of which meet at the thinnest point 11. The four segments 12 are identical to each other, so that they may be manufactured on a milling machine one after the other using the same milling program.

Figure 1:
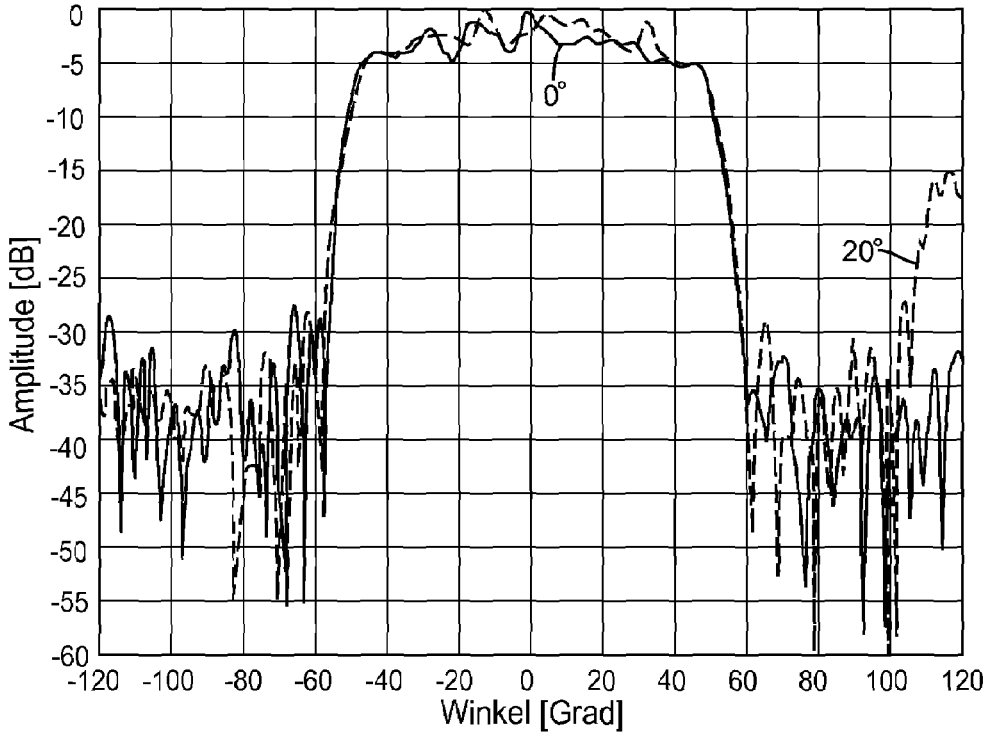
Fig. 1 PRIOR ART
FIG. 1, already discussed, shows an azimuth cut of a conventional antenna assembly.
Figure 6:
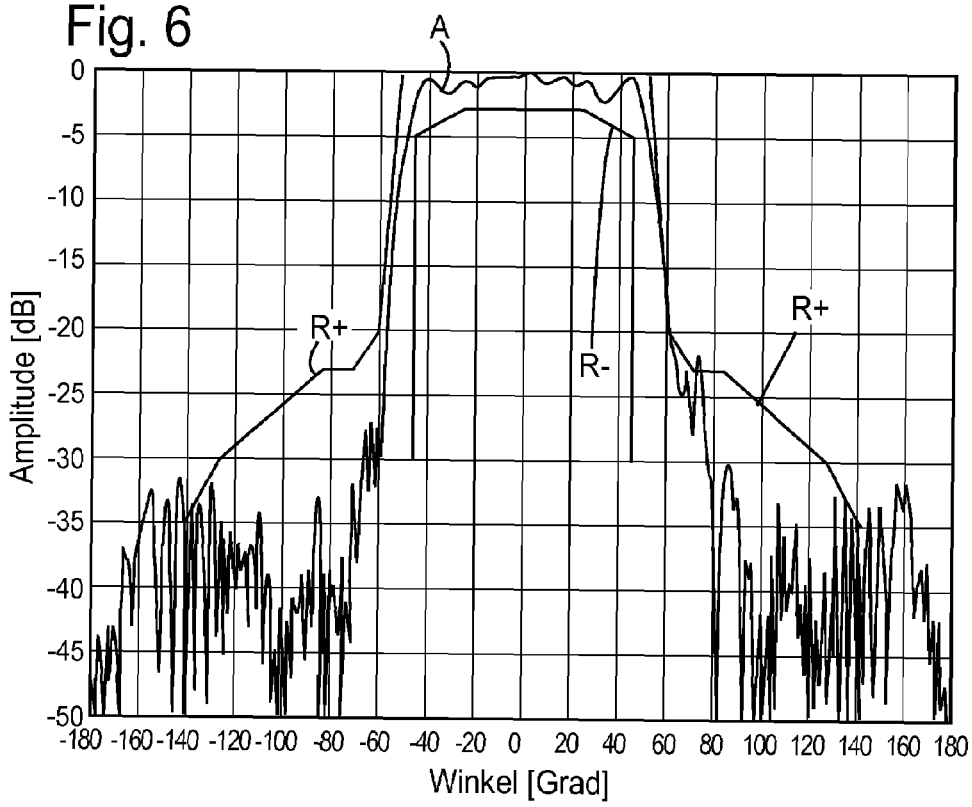
FIG. 6 shows an azimuth cut of an antenna assembly according to the invention at perpendicular incidence to the cladding plate.

FIG. 6 shows an azimuth cut analogous to FIG. 1, of an antenna assembly having a cladding plate with a thickness profile of the type shown in FIG. 5, and a 90°-sector antenna which is located, as shown in FIG. 3, at the surface normal of the cladding plate at its thinnest point 11, and the main beam direction of which, similar to beam 3 in FIG. 3, coincides with the surface normal. The amplitude curve A fits well between the constraint curves R+, R− which represent an expected maximum at minimum amplitude as a function of the azimuth angle, respectively. Only at the outer flanks of curve R+, there is a contact with amplitude curve A.

Figure 7:
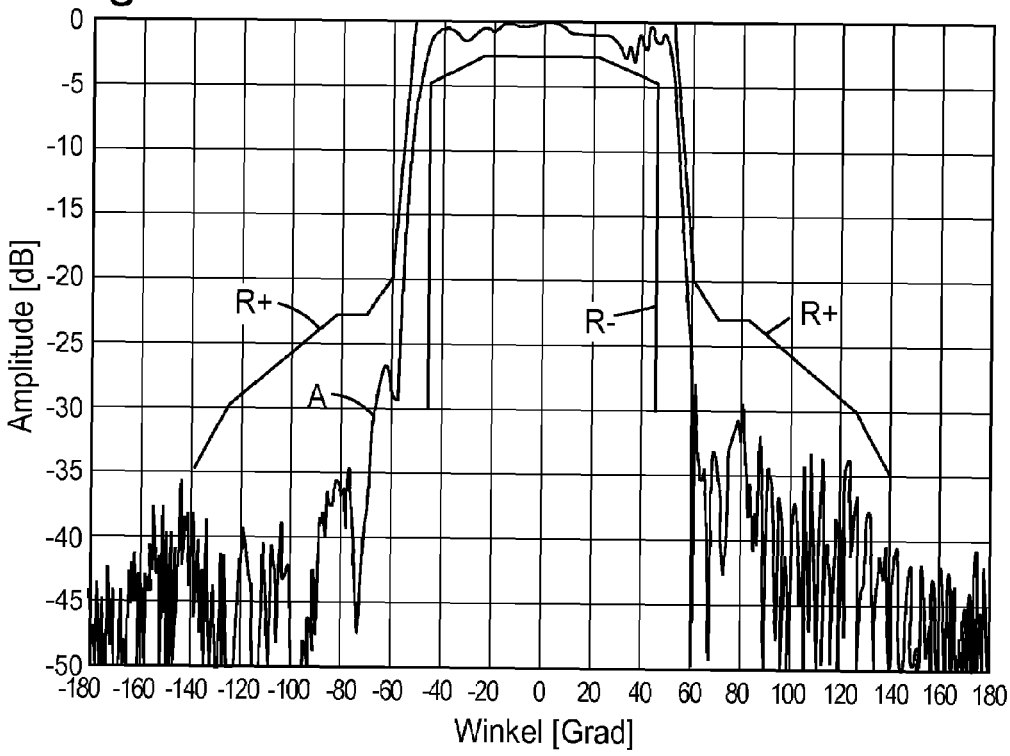
FIG. 7 an azimuth cut under oblique incidence.

FIG. 7 shows a similar azimuth cut for the same antenna and the same cladding plate as in FIG. 6, in this case with the main beam direction of the antenna intersecting the surface normal of the cladding plate at an angle of 23°. In contrast to the conventional case of FIG. 1, a specular image of the main beam which would be expected at an angle of 140° to 150° is missing completely in FIG. 7. There is no reflection of the radio beam impinging at an oblique angle onto the cladding plate.

Figure 2:
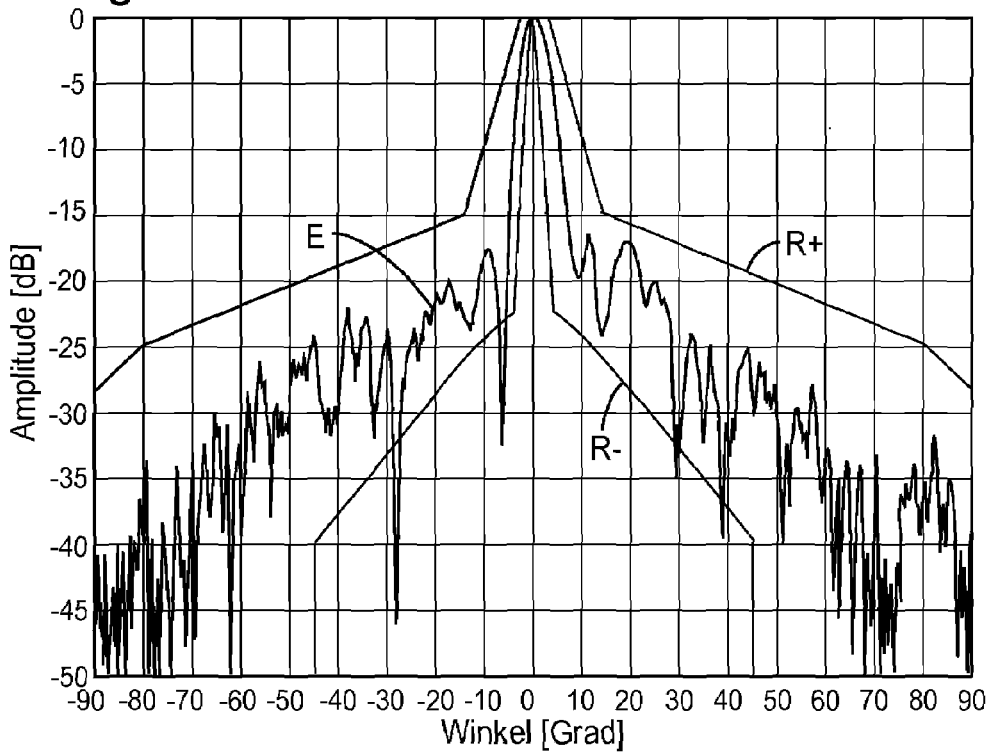
Fig. 2 PRIOR ART
FIG. 2 shows an elevation cut of a conventional antenna assembly.
Figure 8:
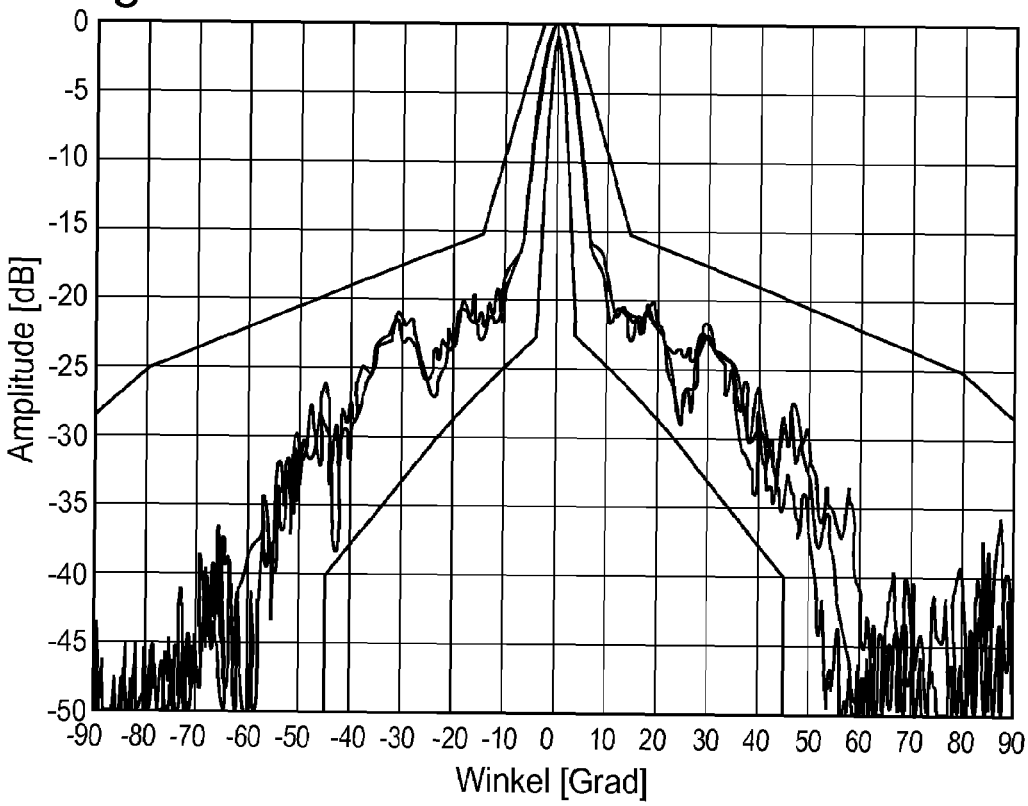
FIG. 8 elevation cuts at various angles of incidence.

FIG. 8 shows elevation cuts of the antenna assembly, as in case of FIG. 2, for various different angles of incidence and distances between the antenna and the cladding plate. The extinctions which are clearly visible in FIG. 2 are missing completely here.

The thickness modulated cladding plate according to the present invention enables the cladding plate and the antenna to be positioned variably with respect to each other, so that the orientation of the cladding plate may be matched to a building front in which the plate must be fitted, even if the main beam direction of the antenna cladded by it is noticeably different from a normal direction of the building front.

The invention claimed is:

1. A cladding plate for a microwave antenna, the cladding plate comprising:

a plate;

a recess formed in the plate and extending radially towards a peripheral edge of the plate from a thinnest point of the plate such that a thickness of the plate increases radially from the thinnest point in proportion to $$\frac{1}{\sqrt{1-(\varepsilon_R + a/r^2)^{-1}}}$$

wherein r is a radial distance from the thinnest point;

wherein $\in_R$ is the dielectric constant of the plate material; and wherein a is a positive constant.

2. The cladding plate of claim 1 wherein the recess is milled into the plate to form a thickness profile of the plate.

3. The cladding plate of claim 2 wherein the thickness profile of the plate increases stepwise from the thinnest point of the plate.

4. The cladding plate of claim 3 wherein a height of a step in the thickness profile is less than 100 μm.

5. The cladding plate of claim 1 wherein the plate comprises a homogeneous material.

6. The cladding plate of claim 1 wherein the plate comprises a plurality of sections.

7. The cladding plate of claim 6 wherein each section contacts each of the other sections at the thinnest point of the plate.

8. An antenna assembly comprising:

a microwave antenna;

a cladding plate configured to intersect a beam emitted by the microwave antenna, the cladding plate having a thickness d that increases with a distance r from a thinnest point of the cladding plate; and the microwave antenna being located at a distance from the cladding plate, the distance being measured along a surface normal from the thinnest point of the cladding plate.

9. The antenna assembly of claim 8 wherein the thinnest point of the cladding plate has a thickness given by:

$$d_{\min} = \frac{m}{2}\frac{\lambda_0}{\sqrt{\varepsilon_R}}$$

wherein m is an integer;

wherein $\lambda_0$ is an operating wavelength of the microwave antenna in a vacuum; and wherein $\in_R$ is the dielectric constant of a material that comprises the cladding plate.

10. The antenna assembly of claim 9 wherein the cladding plate has a maximum thickness given by:

$$d_{\max} < \frac{m}{2}\frac{\lambda_0}{\sqrt{\varepsilon_R - 1}}.$$

11. The antenna assembly of claim 8 wherein the thickness of the cladding plate increases with the distance r proportional to:

$$\frac{1}{\sqrt{1-(\varepsilon_R + a/r^2)^{-1}}},$$

wherein $\alpha = \in_R D^2$;

wherein r denotes a radial distance from the point of minimum thickness of the cladding plate; and wherein D denotes a distance of the microwave antenna from the cladding plate.

12. The antenna assembly of claim 11 the distance D is approximately 10 to 20 wavelengths of a radio signal emitted or received by the antenna.

* * * * *

UNITED STATES PATENT AND TRADEMARK OFFICE

CERTIFICATE OF CORRECTION

PATENT NO. : 7,633,457 B2
APPLICATION NO. : 10/597212
DATED : December 15, 2009
INVENTOR(S) : Jochen Christ It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 273 days.

Signed and Sealed this

Ninth Day of November, 2010

David J. Kappos

David J. Kappos
*Director of the United States Patent and Trademark Office*